US006147608A

United States Patent [19]

Thacker

[11] Patent Number: 6,147,608

[45] **Date of Patent: *Nov. 14, 2000**

[54] OCCUPANCY STATUS INDICATOR

[76] Inventor: Ralph W. Thacker, P.O. Box 1416, Ferndale, Calif. 95536

[ * ] Notice: This patent issued on a continued prosecution application filed under 37 CFR 1.53(d), and is subject to the twenty year patent term provisions of 35 U.S.C. 154(a)(2).

[21] Appl. No.: 09/431,718

[22] Filed: Oct. 28, 1999

[51] Int. Cl.[7] ..... G08B 23/00

[52] U.S. Cl. ..... 340/573.1; 340/573.4; 340/521; 340/522; 340/330; 340/331

[58] Field of Search ..... 340/573.1, 573.4, 340/517, 521, 522, 565, 566, 567, 330, 331, 332

[56] References Cited

U.S. PATENT DOCUMENTS

| | | | |
|---|---|---|---|
| 3,964,058 | 6/1976 | Winston . | |
| 4,340,879 | 7/1982 | Laflamme . | |
| 4,476,461 | 10/1984 | Carubia . | |
| 4,679,034 | 7/1987 | Kamada . | |
| 4,719,363 | 1/1988 | Gallacher | 340/556 |
| 5,371,489 | 12/1994 | Carroll et al. . | |
| 5,576,972 | 11/1996 | Harrison | 364/516 |
| 5,703,367 | 12/1997 | Hashimoto et al. . | |
| 5,717,867 | 2/1998 | Wynn et al. . | |
| 5,781,108 | 7/1998 | Jacob et al. | 340/552 |
| 5,861,806 | 1/1999 | Vories et al. . | |
| 5,973,594 | 10/1999 | Baldwin et al. | 340/506 |

*Primary Examiner*—Jeffery A. Hofsass
*Assistant Examiner*—Hung T. Nguyen
*Attorney, Agent, or Firm*—Jack Lo

[57] ABSTRACT

A system is disclosed for indicating the status of a person occupying a cubicle, office or other enclosed space by means of automatically or manually initiated visual or audio-visual signals, particularly relating to the occupant's presence, the relative length of absences, the wish to work without being disturbed, and the need for emergency assistance. The system is controlled by a control unit with a microcontroller, a communications link, a red button, an amber button and a green button, each having a lamp of the corresponding color. A motion detector is connected to the control unit for detecting the presence or absence of motion in the monitored space. A proximity detector is connected to the control unit for detecting the passage of a person through the doorway of the monitored space. Also connected to the control unit is an indicator unit with a beeper and red, amber and green lamps functioning in tandem with the lamps of the control unit. In a first embodiment, status signals are activated locally and remotely via linkage to a communications network. In a second embodiment, a personal computer is connected to the control unit to enter messages, send and receive status signals and messages, change default settings, and adjust selected signal settings from remote locations. The indicator lamps are implemented as graphics on a monitor and commands are entered by hot key combinations on a keyboard. If the computer has voice recognition capability, commands may be entered verbally.

14 Claims, 8 Drawing Sheets

OCCUPANCY STATUS INDICATOR

BACKGROUND OF THE INVENTION

1. Field of the Invention

This invention relates generally to occupancy status monitoring and signaling systems.

2. Prior Art

In many office environments, the occupancy of tall cubicles and enclosed offices cannot be ascertained from a distance. A worker looking for another worker must walk to a cubicle or office to see if the person is there. Time is wasted when after all the walking, the person being sought is not in the cubicle or office. Further, a person being threatened with physical violence or experiencing a medical emergency may not be able to signal for help from other workers from within the confines of a cubicle or office.

Various devices for indicating occupancy in a room are known. U.S. Pat. No. 5,371,489 to Carroll et al. discloses a motion detector that activates a constant white light and a flashing red light upon detecting motion. However, it cannot detect the presence of a stationary person, so it may turn off the lights when the room is still occupied. In practice, this problem may be reduced by turning on the lights for a predetermined time after detection of motion. However, if a person leaves the room shortly after triggering the lights, the lights may stay on to indicate occupancy erroneously. Further, the light signals can only been seen by nearby people or those with a direct line of sight, but they cannot be seen by people in other cubicles or in other rooms. U.S. Pat. No. 4,476,461 to Carubia discloses an occupancy indicator that includes switches for monitoring occupancy in remote locations. Signals from the switches are transmitted to an occupancy information recorder through a communication circuit. However, it does not provide a visual indication of occupancy at the locations being monitored. U.S. Pat. No. 4,340,879 to Laflamme shows a device for indicating the presence of workers. It includes a plurality of indicators that are individually and manually operated to indicate if a corresponding person is in or out. It is for being used in a reception area. It does not provide automatic detection of occupancy in cubicle and rooms. U.S. Pat. No. 3,964,058 to Winston shows a lighted "Do Not Disturb" sign which is manually operated. It also does not provide automatic detection of occupancy in cubicle and rooms.

OBJECTS OF THE INVENTION

Accordingly, objects of the present occupancy status indicator are:

- to provide automatic signals indicating whether or not a cubicle or office is occupied;
- to provide an automatically or manually activated audio-visual alarm when an occupant needs medical attention;
- to provide an automatically or manually activated signal to indicate that the occupant is absent for a shorter or a longer period of time;
- to provide a manually activated signal to announce that the occupant wishes not to be disturbed.

Further objects of the present invention will become apparent from a consideration of the drawings and ensuing description.

BRIEF SUMMARY OF THE INVENTION

The present occupancy status indicator is comprised of a control unit that includes a microcontroller programmed with control firmware, a communications link, a red illuminated button, an amber illuminated button, and a green illuminated button. A motion detector is connected to the control unit for detecting the presence or absence of motion in a cubicle, office, or other space. A proximity detector is connected to the control unit for detecting the passage of a person through a doorway of the space. An indicator with red, amber, and green lamps, and a beeper is also connected to the control unit. In a first embodiment, automatic and manual commands activate various displays of the lamps and operation of the beeper to indicate the presence or absence of a user, the relative duration of the absence, the user's wish to not be disturbed, or the need for emergency assistance and send those signals to remote locations on a communications network if one is connected. In a second embodiment, a personal computer is connected to the control unit of the occupancy status indicator to facilitate changing the amounts of time allocated to absence and "Do Not Disturb" periods, to enter messages, to receive status signals and messages and to change selected signal settings from remote locations. The indicator lamps are implemented as graphics on a monitor. Status inquiries, written messages and changes in program configuration are entered by hot key combinations on a keyboard.

DETAILED DESCRIPTION OF THE INVENTION

Figure 1:
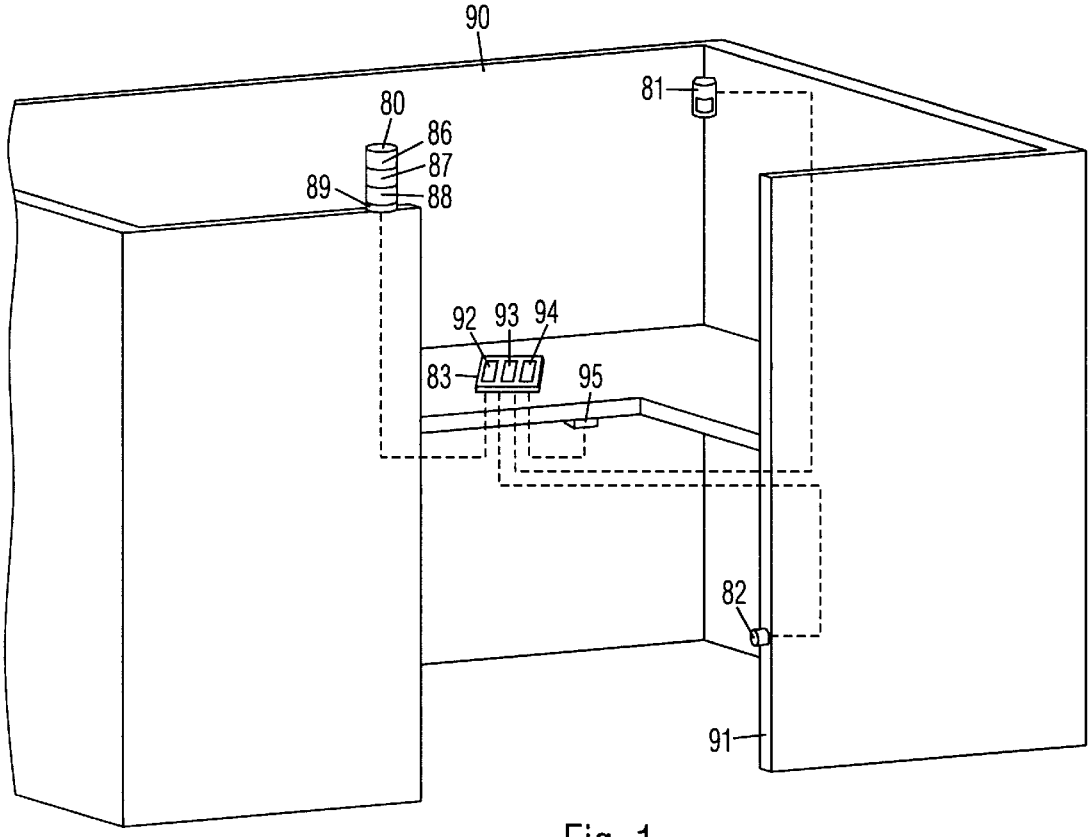
FIG. 1 is a front perspective view of a first embodiment of an occupancy status indicator installed in a cubicle.

FIG. 1:

A first embodiment of the present occupancy status indicator is shown installed in a cubicle or monitored space 90 in FIG. 1. A control unit 83 is connected to a motion detector 81 directed into space 90, a proximity detector 82 is directed across a doorway 91 of space 90, and an indicator unit 80 is positioned in an easily visible location, such as on top of the cubicle. Indicator unit 80 includes a first lamp 86 which is preferably red, a second lamp 87 which is preferably amber, a third lamp 88 which is preferably green, and an audio signaling device or beeper 89. Lamps 86–88 are visible 360 degrees around indicator unit 80. Control unit 83 includes a first illuminated button 92 which is preferably red, a second illuminated button 93 which is preferably amber, and a third illuminated button 94 which is preferably green. The illuminated buttons may each have a lamp and a switch that are combined into a single unit, or may feature the lamp and switch as separate units. Control unit 83 includes a microcontroller loaded with a control program.

Illuminated buttons 92–94 and lamps 86–88 can operate in either a constant or a flashing mode. Pressing one of illuminated buttons 92–94 on control unit 83 respectively activates lamps 86–88 on indicator unit 80 in the same mode, whether constant or flashing. E.g., when red illuminated button 92 is flashing, red lamp 86 is also flashing, and when red illuminated button 92 is constant, red lamp 86 is also constant. Being synchronized to lamps 86–88, illuminated buttons 92–94 enable a user to monitor the operation of indicator unit 80 without having to look at it. Some exemplar signals are as follows:

1. Occupied: constant green lamp.
2. Do Not Disturb: flashing green lamp.
3. Short Absence: flashing amber lamp.
4. Long Absence: constant amber lamp.
5. Emergency Signal: flashing red lamp and intermittent beeper.

When motion detector 81 detects motion in space 90, green lamp 88 in indicator unit 80 is displayed in a constant mode to indicate the presence of a person. If motion detector 81 subsequently detects no motion in the space and proximity detector 82 has not been triggered, red lamp 86 is flashed and beeper 89 is sounded intermittently to indicate an emergency. If motion detector 81 detects no motion in the space and proximity detector 82 has been triggered, amber lamp 87 is flashed to signal a relatively short duration absence. If a predetermined length of time allocated to short duration absences elapses without motion being detected by motion detector 81, amber lamp 87 is switched from a flashing to a constant mode to signal a relatively long duration absence. The emergency alarm signal, absence signals, as well as a "Do Not Disturb" signal and commands to reset an internal clock and restart the program, may be manually activated by pushing the appropriate button or combination of buttons on control unit 83.

One or more functional modules may be joined to the microcontroller of the control unit to expand the ability to send, receive, and record signals and/or information. These functional modules include but are not limited to: a parallel interface to permit attachment of a printer, a network interface to enable direct access to a communications network, an audible alert module to give an audible signal whenever status is accessed remotely, a voice module to record voice messages, an LCD display to record and display written messages, and a telephone module to allow status to be accessed and settings to be changed from a telephone. A concealed switch 95 may be connected to the control unit 83 for sending a silent alert to one or more remote locations if the occupant of space 90 is being physically threatened by a third party.

Figure 2:
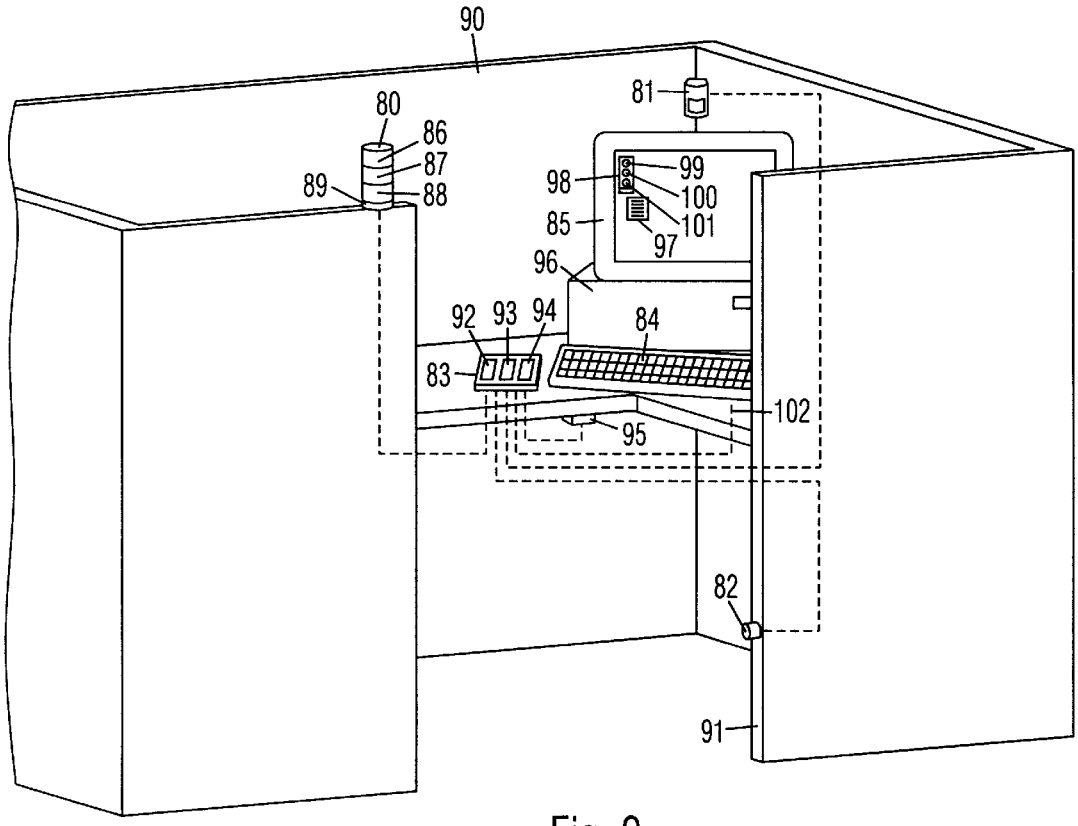
FIG. 2 is a front perspective view of a second embodiment thereof.

FIG. 2:

A second embodiment of the present occupancy status indicator is shown installed in a cubicle or monitored space 90 in FIG. 2. Indicator unit 80, motion detector 81, proximity detector 82, and concealed switch 95 are connected to control unit 83 for sending silent alerts as in the first embodiment in FIG. 1. In addition, a personal computer 96 is connected to control unit 83 by an interface or communications link 102 that may include but is not limited to a serial interface, a parallel interface, a USB interface, a "FIRE WIRE" interface, an infrared interface, and a wireless radio frequency interface. Computer 96 includes a keyboard 84 and a monitor 85. As in the first embodiment, the occupancy status indicator is activated automatically or manually by pressing one or more of the buttons on the control unit. The indicator lamps are implemented as graphics on monitor 85. Combinations of hot keys on keyboard 84 may be used to change the amounts of time allocated to absence and "Do Not Disturb" periods, to enter messages, to receive status signals and messages, and to change selected signal settings from remote locations The following combinations of hot keys represent one possible arrangement:

1. Simultaneously depressing the right-hand "Alt" and "Ctrl" keys displays a menu 97 on monitor 85 with options for checking status of other persons, posting notices of one's whereabouts during a long duration absence, activating signals remotely, and establishing or changing one's password. Invoking the "status-checking" option produces a submenu with options for creating and checking lists of persons in designated work groups for whom occupancy status might be desired, e.g., the department, the division, the building and the entire organization. Selecting one of these options produces a further submenu with a list of names from which the person for whom status is desired may be selected. Selecting a "Notice-Posting", a "Signal-Activation", or a "Password" option produces a dialog box asking for the user's password. Once the password is entered and verified, another dialog box appears for the entry of a brief message or showing the current status of the indicator unit located in the inquiring person's office or workstation, and offering the options to activate the settings for long duration absence, and/or permitting the establishment or changing of the password.
2. Simultaneously pressing hot keys, such as the right-hand "Alt" and "M" keys, produces a dialog box asking for the user's password. Once the password is entered and verified, another dialog box appears permitting changes in the amount of time allocated to the working day, short duration absence, long duration absence, and "Do Not Disturb" periods. This dialog box also includes the choice for recognizing the changed settings as the default settings. When status is accessed from computer 96, an icon 98 appears briefly in the upper left-hand comer of monitor 85, having red, amber and green graphics 99–101 replicating the status of the red, amber and green lamps 86–88 on indicator unit 80 of the target cubicle or office.

The occupancy status indicator may be operated with voice commands, if voice recognition capability is available on computer 96. The voice commands are preferably "Help" for emergencies, "Short" for short absence, "Long" for long absence, "Quiet" for do-not-disturb, "Status" for checking on the display of signals on indicator unit 80, and "Access" for initiating checks on the status of other persons, for posting notices, for activating signals remotely and for establishing or changing passwords.

FIGS. 3A–3G:

FIGS. 3A–3G are a flowchart of the control program loaded into the control unit of FIG. 1 and FIG. 2. Upon power up, the space is continuously monitored for motion at step 1 in routine A. When motion is detected, the green lamps are automatically displayed in the constant mode at step 2 to signal that the space is occupied. Otherwise, the program will remain at step 1 in routine A.

When the green lamps are displayed in the constant mode at step 2, the red button on the control unit may be pressed at step 3 to activate the emergency alarm. The green lamps are turned off at step 9 and the program branches to the emergency alarm routine B shown in FIG. 3C. If the red button is not pressed at step 3, but the absence of motion is detected at step 4, and the proximity detector has not detected the passage of a person through the entrance at step 8, the constant green lamps are turned off at step 9, and the program branches to emergency alarm routine B.

Figure 3A:
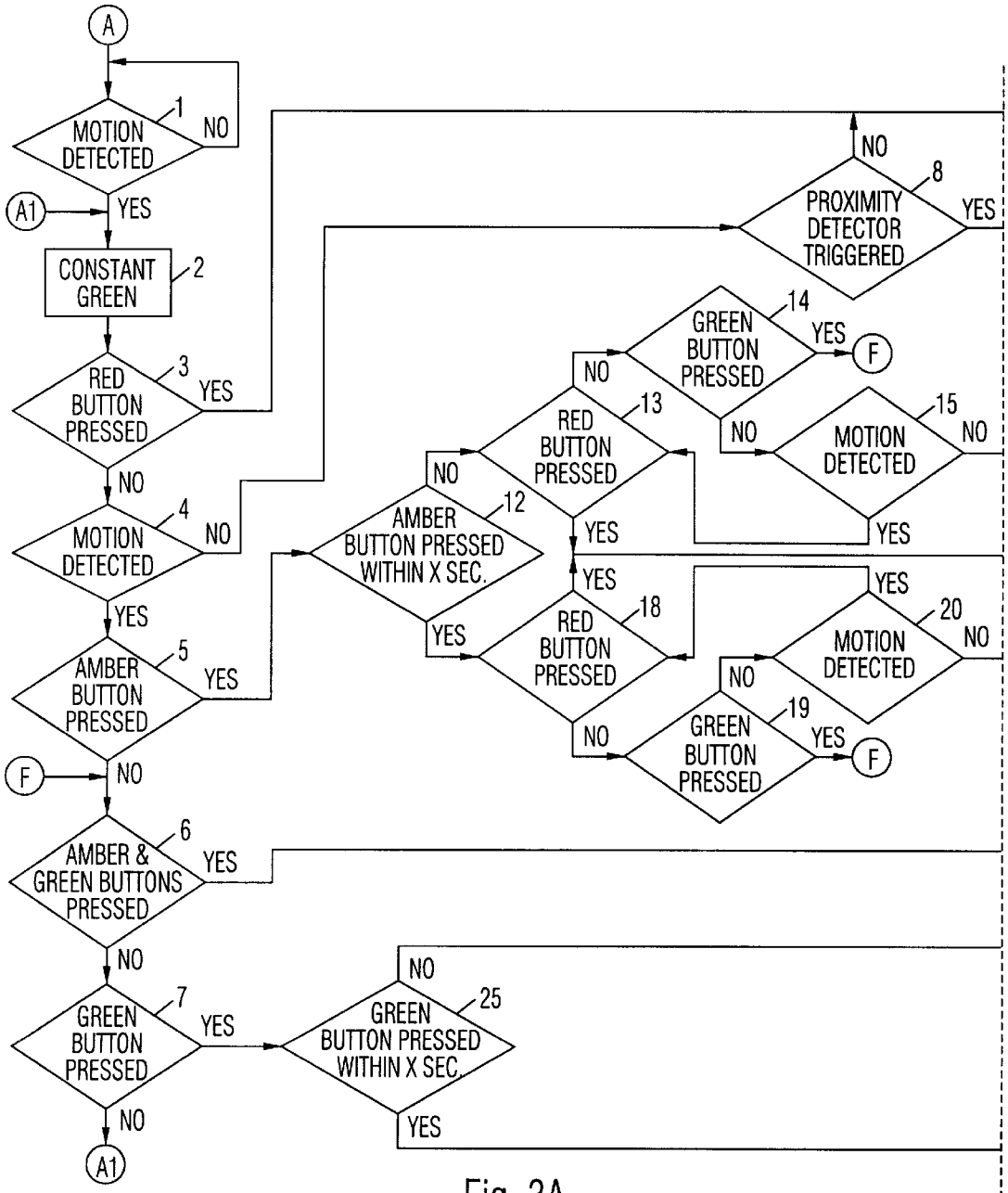
FIG. 3A is a partial flowchart of the control software thereof.
Figure 3B:
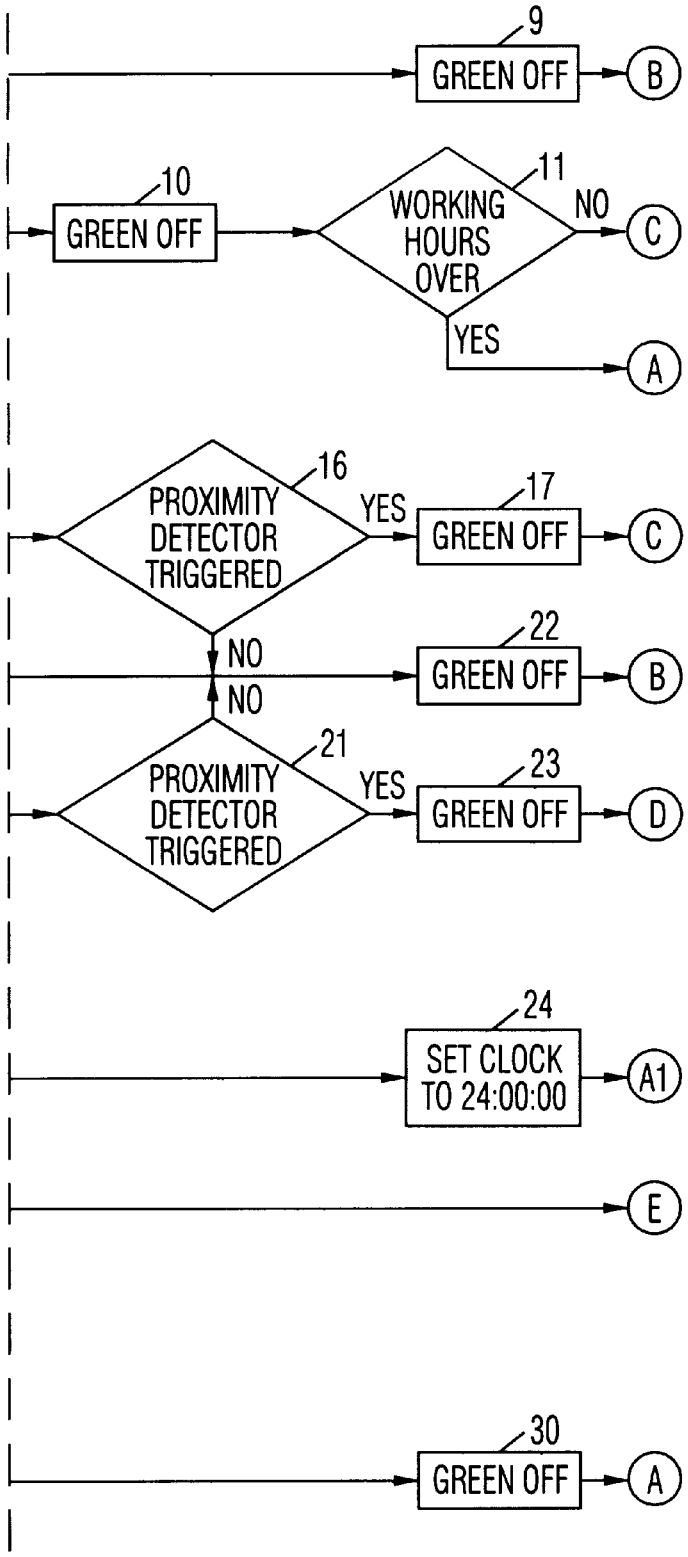
FIG. 3B is a partial flowchart of the control software thereof.
Figure 3C:
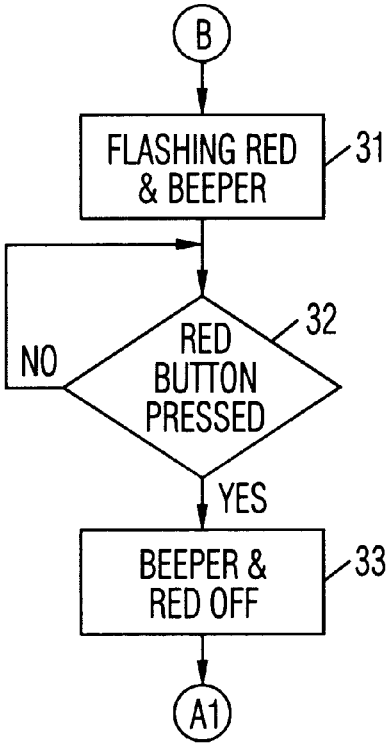
FIG. 3C is a partial flowchart of the control software thereof.

When the emergency alarm routine B in FIG. 3C is activated, the red lamps are flashed and the beeper is sounded intermittently at step 31. This audio-visual alarm continues until the red button is pressed at step 32, at which time the flashing red lamps and the intermittent beeper are turned off at step 33, and the program returns to step 2 in FIG. 3A. The emergency alarm signal may be sent to one or more selected locations on a computer network, if one is connected.

When the green lamps are displayed in the constant mode at step 2, the red button is not pressed at step 3, no motion is detected at step 4, and the proximity detector has detected the passage of a person through the doorway at step 8, the green lamps are automatically turned off at step 10. If the occupant has exited during predetermined working hours at step 11, the program branches to the short duration absence routine C in FIG. 3D. If the occupant has exited after working hours at step 11, the program returns to step 1.

Figure 3D:
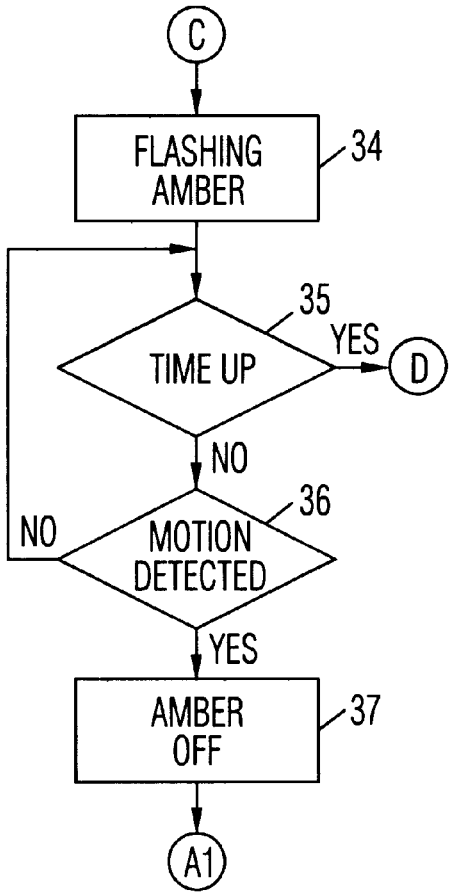
FIG. 3D is a partial flowchart of the control software thereof.

When the short duration absence routine C in FIG. 3D is activated, the amber lamps are displayed in the flashing mode at step 34. The program begins a countdown period at step 35. If motion is detected during the countdown period at step 36, the flashing amber lamps are turned off at step 37, and the program returns to step 2 of routine A in FIG. 3A. If no motion is detected during the countdown period at step 36, the program returns to step 35. When the countdown period has elapsed at step 35, the program automatically branches to the long duration absence routine D in FIGS. 3E and 3F.

If there is no intentional branching at step 3 or automatic branching at step 4 to the emergency alarm routine, and no automatic branching to the short duration absence routine at step 11, pressing the amber button at step 5 initiates branching to the absence routines. If the amber button is not pressed a second time within a predetermined number of seconds at step 12, the program initiates branching to the short duration absence routine. If the amber button is pressed a second time at step 12, the program initiates branching to the long duration absence routine in FIG. 3D. In either case, the red button may be utilized at step 13 or 18 to turn off the green lamps at step 22 and branch to the emergency alarm routine B in FIG. 3C. If the emergency alarm is not manually initiated, the green button may be pressed at steps 14 or 19 to cancel either absence routine branching command entered at step 5, or steps 5 and 12. Otherwise, the program waits until no motion is detected at step 15 or 20, and the proximity detector is triggered at steps 16 or 21 before turning off the green lamps at steps 17 or 23, and proceeding to the short duration absence routine C in FIG. 3C, or to the long duration absence routine D in FIGS. 3E and 3F. If no motion is detected at step 15 or 20, and the proximity detector is not triggered step 16 or 21, the program automatically turns off the green lamps at step 22 and branches to the emergency alarm routine B in FIG. 3C.

Figure 3E:
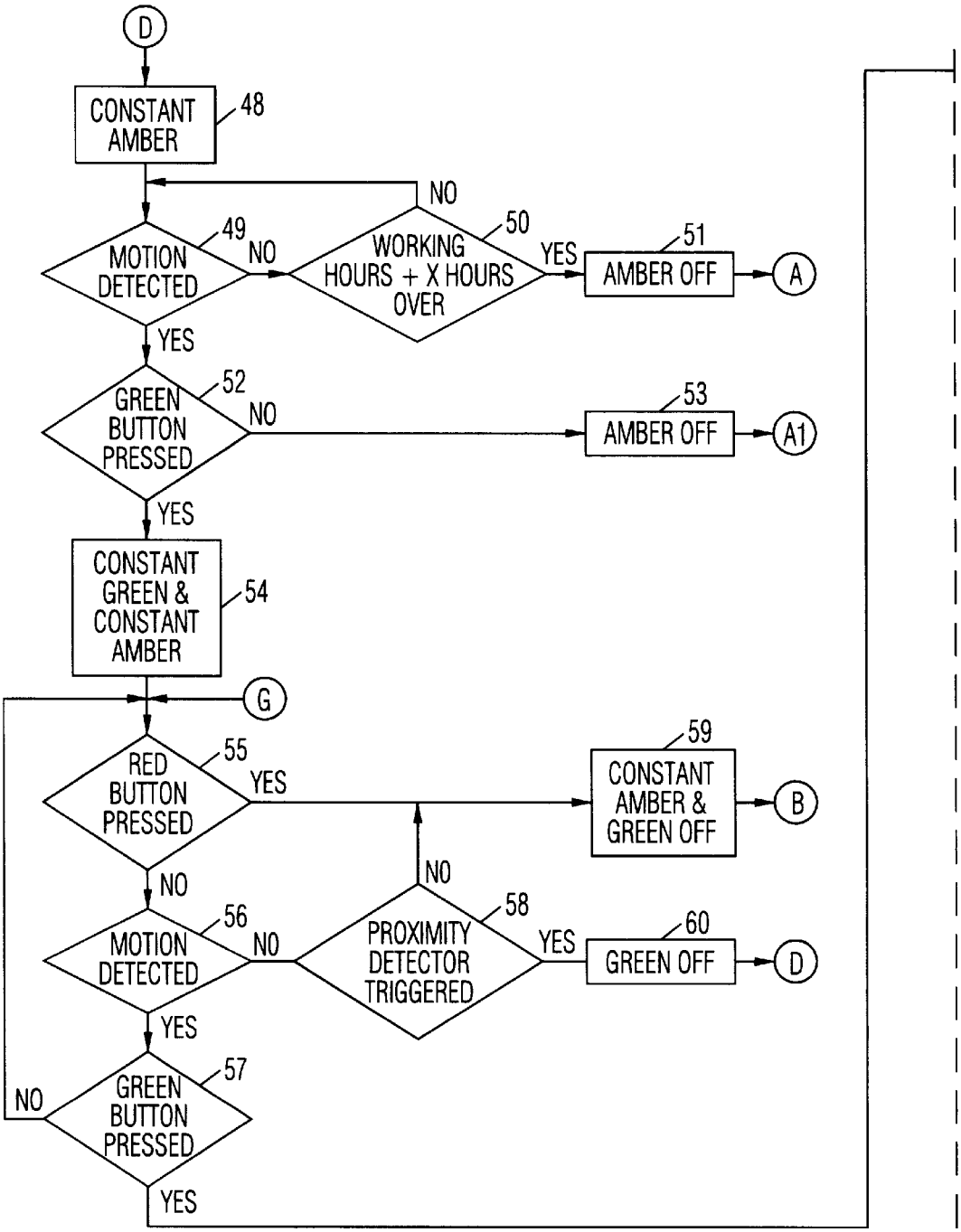
FIG. 3E is a partial flowchart of the control software thereof.
Figure 3F:
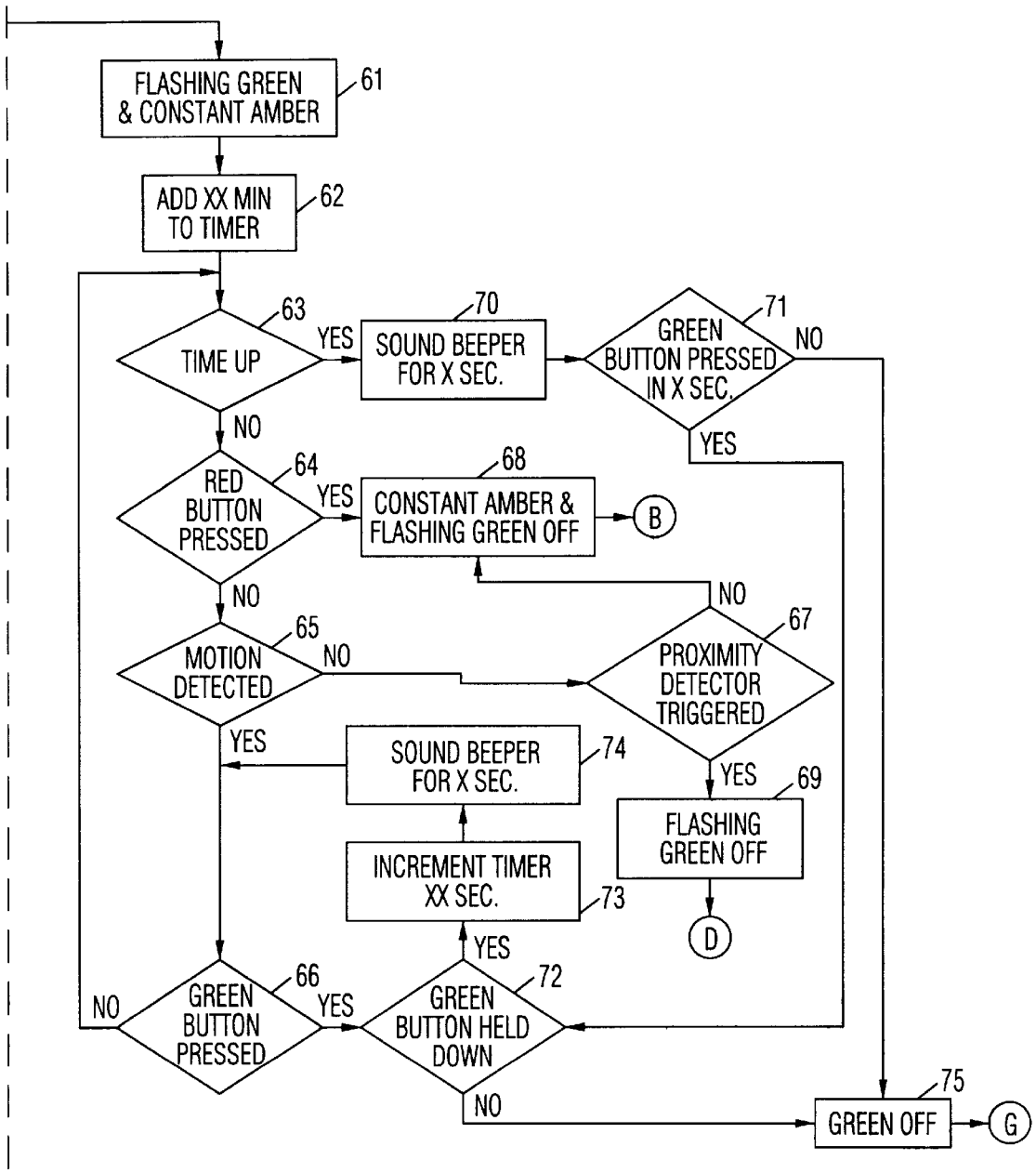
FIG. 3F is a partial flowchart of the control software thereof.

When the long duration absence routine D in FIGS. 3E and 3F is initiated, the amber lamps are displayed in the constant mode at step 48. If no motion is detected at step 49 and working hours have not ended at step 50, the motion checking continues. If no motion is detected at step 49 and working hours have ended at step 50, the program automatically turns off the constant amber lamps at step 51 and returns to step 1 in routine A in FIG. 3A. If motion is detected at step 49, indicating that someone has entered the workspace, and the green button is not pressed at step 52, the constant amber lamps are automatically turned off at step 53, and the program returns to step 2 of routine A in FIG. 3A. If the green button is pressed at step 52, the green lamps are displayed in the constant mode at step 54 in combination with the amber lamps. The simultaneous display of constant amber and constant green lamps signals that the space is being used by one or more visitors during the regular occupant's absence.

When the amber and green lamps are being displayed together in the constant mode at step 54, the red button may be pressed at step 55 to turn off the constant amber and green lamps at step 59, and initiate the emergency alarm routine B in FIG. 3C. If the emergency alarm routine is not initiated manually at step 55 but no motion is detected at step 56, the program checks for triggering of the proximity detector at step 58. If the proximity detector is not triggered at step 58, the program turns off the constant amber and green lamps at step 59, and branches to the emergency alarm routine B in FIG. 3C. If the proximity detector has been triggered at step 58, the constant amber and green lamps are turned off at step 60, and the program returns to step 48. If motion is detected at step 56, and the green button is not pressed at step 57, the program returns to step 55.

If the green button is pressed at step 57, the green lamps are switched from the constant mode to the flashing mode at step 61 in FIG. 3F and displayed in combination with the constant amber lamps to indicate that the visitors to the workspace wish not to be disturbed. A predetermined amount of time is automatically added to a timer at step 62. The program begins a countdown period at step 63. During the "Do Not Disturb" period, the red button may be pressed at step 64 to turn off the constant amber and flashing green lamps at step 68 and branch to the emergency alarm routine B in FIG. 3C. If the emergency alarm routine is not initiated manually at step 64, no motion is detected at step 65, and the proximity detector is not triggered at step 67, the constant amber and flashing green lamps are turned off at step 68 and the program branches to the emergency alarm routine B in FIG. 3C. If the proximity detector is triggered at step 67, the flashing green lamps are turned off at step 69 and the program returns to step 48 in FIG. 3E. Pressing the green button at step 66 and holding it down at step 72 adds one or more increments of time to the timer at step 73. The beeper sounds for a fraction of a second at step 74 to register each additional increment of time. If the green button is pressed at step 66 but not held down at step 72, the program turns off the flashing green lamps at step 75 and returns to step 55 in FIG. 3E. If the green button is not pressed at step 66, the program returns to step 63. When the amount of time added to the timer by default and/or by choice has elapsed at step 63, the beeper is sounded for a fraction of a second at step 70 to indicate that the "Do Not Disturb" period is over. The green button may be pressed within a few seconds at step 71 to extend the period via steps 72–74 as described above. If the green button is not pressed at step 71, the flashing green lamps are turned off at step 75 and the program returns to step 55.

When the green lamps are being displayed in the constant mode at step 2, and no emergency routine at step 3 or 4, or absence routine at step 11 or 5 is initiated, the amber and green buttons of may be pressed simultaneously at step 6 to reset the internal clock to "24:00:00" at step 24 and return to step 2.

When the green lamps are displayed in the constant mode at step 2, and no emergency routine is initiated at step 3 or 4, no absence routine is initiated at step 11 or 5, and no clock-reset routine is initiated at step 6, the green button may be pressed at step 7 to initiate the "Do Not Disturb" routine or to restart the program. If the green button is pressed again at step 25, the program turns off the green lamps at step 30 and returns to step 1. If the green button is not pressed again at step 25, the program branches to the "Do Not Disturb" routine E in FIG. 3G. If the green button is not pressed at step 7, the program returns to step 2.

Figure 3G:
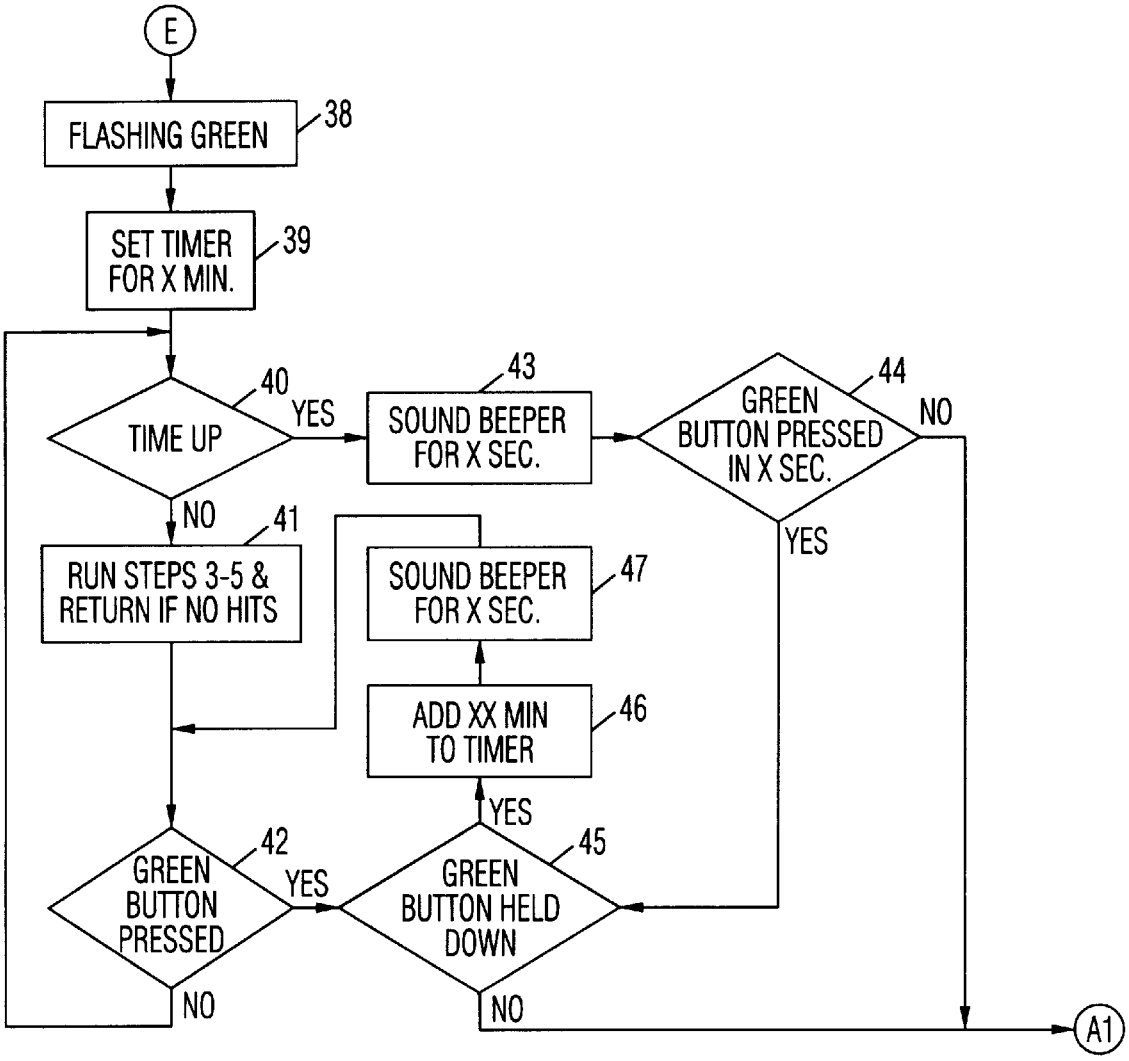
FIG. 3G is a partial flowchart of the control software thereof.

When the "Do Not Disturb" routine E in FIG. 3G is initiated, the green lamps are displayed in the flashing mode at step 38 and a predetermined amount of time is automatically added to the timer at step 39. The program begins a countdown period at step 40. During the "Do Not Disturb" period, the program checks for the manual or automatic initiation of the emergency or absence routines at step 41 and branches accordingly. If no branches occur, the green button may be pressed at step 42 and held down at step 45 to add one or more increments of time to the timer at step 46. The beeper sounds for a fraction of a second at step 47 to register each additional increment of time. If the green button is pressed at step 42 but not held down at step 45, the program returns to step 2 in FIG. 3A. If the green button is not pressed at step 42, the program returns to step 40. When the amount of time added to the timer by default and/or by choice has elapsed at step 40, the beeper sounds for a fraction of a second at step 43 to indicate that the "Do Not Disturb" period is over. The green button may be pressed within a few seconds at step 44 to extend the period via steps 45–47 as described above. If the green button is not pressed at step 44, the program returns to step 2 in FIG. 3A.

If the control unit is linked to a communications network, either independently or through a computer, and the occupant of the space is physically threatened by a third party, he or she may turn on a concealed switch that prompts the program to send an alert to one or more remote locations without an audio-visual alarm being given at the sender's location. The silent alert is continued until the concealed switch is turned off.

Although the above description is specific, it should not be considered as a limitation on the scope of the invention, but only as an example of the preferred embodiments. Many variations are possible within the teachings of the invention. Therefore, the scope of the invention should be determined by the appended claims and their legal equivalents, not by the examples given.

I claim:

1. An occupancy status indicator, comprising:

a motion detector for detecting motion in an enclosed space and thus the presence of a person in said space;

a proximity detector for detecting the passage of said person through a doorway of said space;

an indicator including a lamp and a beeper; and a control unit connected to said motion detector, said proximity detector, and said indicator, said control unit being arranged to:

activate said lamp in a first mode when said motion detector detects motion in said space for indicating that said space is occupied by said person;

activate said lamp in a second mode and activate said beeper when said motion detector detects no motion in said space and said proximity detector detects no one passing through said doorway for indicating an emergency in said space; and deactivate said lamp when said motion detector detects no motion in said space and said proximity detector detects the passage of said person through said doorway for indicating that said person has left said space.

2. An occupancy status indicator, comprising:

a motion detector for detecting motion in an enclosed space and thus the presence of a person in said space;

a proximity detector for detecting the passage of said person through a doorway of said space;

an indicator including a first color lamp, a second color lamp, a third color lamp, and a beeper; and a control unit connected to said motion detector, said proximity detector, and said indicator, said control unit being arranged to:

activate said third color lamp when said motion detector detects motion in said space for indicating that said space is occupied by said person;

deactivate said third color lamp when said motion detector detects no motion in said space and said proximity detector detects the passage of said person through said doorway, and activate said second color lamp in a first mode for indicating that said person has left said space for a short duration;

activate said second color lamp in a second mode after said passage of said person through said doorway and said motion detector detects no motion in said space for a predetermined period for indicating that said person has left said space for a longer duration; and activate said first color lamp and said beeper when said motion detector detects no motion in said space and said proximity detector detects no one passing through said doorway for indicating an emergency in said space.

3. The occupancy status indicator of claim 2, wherein said control unit includes a communications link for being connected to a communications network for sending occupancy status signals to remote locations.

4. The occupancy status indicator of claim 2, further including a concealed switch connected to said control unit for sending a silent alert to a remote location when said person is physically threatened by another person.

5. The occupancy status indicator of claim 2, wherein said control unit includes a first illuminated button, a second illuminated button, and a third illuminated button, said control unit activating said first color lamp, said second color lamp, and said third color lamp, respectively, in different modes when said first illuminated button, said second illuminated button, and said third illuminated button, respectively, are pressed in different sequences for indicating different occupancy statuses of said space, said first illuminated button, said second illuminated button, and said third illuminated button being illuminated simultaneously with said first color lamp, said second color lamp, and said third color lamp, respectively.

6. An occupancy status indicator, comprising:

a motion detector for detecting motion in an enclosed space and thus the presence of a person in said space;

a proximity detector for detecting the passage of a person through a doorway of said space;

an indicator including a first color lamp, a second color lamp, a third color lamp, and a beeper;

a concealed switch for sending a silent alert to a remote location, a control unit connected to said motion detector, said proximity detector, said indicator, and said concealed switch, said control unit including a first color illuminated button, a second color illuminated button, and a third color illuminated button which are respectively illuminated simultaneously with said first color lamp, said second color lamp, and said third color lamp, and a communications link for being connected to a communications network, said control unit being arranged to:

activate said third color lamp in a first mode when said motion detector detects motion in said space for indicating that said space is occupied by said person;

activate said third color lamp in a second mode when said third color illuminated button is pressed for indicating that said person wishes not to be disturbed;

activate said first color lamp and said beeper when said motion detector detects no motion in said space and said proximity detector detects no one passing through said doorway for indicating an emergency in said space;

activate said first color lamp and said beeper when said first color illuminated button is pressed for indicating said emergency in said space;

activate said second color lamp in a first mode when said second color illuminated button is pressed once for indicating that said person has left said space for a short duration;

activate said second color lamp in a second mode after said passage of said person through said doorway and said motion detector detects no motion in said space for a predetermined period for indicating that said person has left said space for a longer duration;

activate said second color lamp in said second mode when said second color illuminated button is pressed a second time for indicating that said person has said left space for said longer duration;

activate said third color lamp in said first mode when said third color illuminated button is pressed once while said second color lamp is activated in said second mode for indicating that said space is occupied by a visitor when said person is absent;

activate said third color lamp in said second mode when said third color illuminated button is pressed a second time while said second color lamp is activated in said second mode for indicating that said visitor wishes not to be disturbed;

send a silent alert to a remote location through said communications link when said concealed switch is activated;

communicate occupancy status of said space to said communications network; and reset an internal clock in said control unit when said second and third color illuminated buttons are pushed simultaneously.

7. The occupancy status indicator of claim 6, further including a computer connected to said control unit, said computer including a keyboard and a display, said computer being arranged to simultaneously display an icon with a first color graphic, a second color graphic, and a third color graphic when said first color lamp, said second color lamp, and said third color lamp on said indicator are respectively activated.

8. The occupancy status indicator of claim 6, further including a computer connected to said control unit, said computer including a keyboard and a display, said computer being arranged to simultaneously display an icon with a first color graphic, a second color graphic, and a third color graphic when said first color lamp, said second color lamp, and said third color lamp on said indicator are respectively activated, said computer being arranged to:

communicate occupancy status of said space to said communications network;

receive occupancy status information of other spaces from said communications network;

post messages to said communications network regarding whereabouts of said person during absences from said space; and change settings of said control unit.

9. An occupancy status indicator, comprising:

a motion detector for detecting motion in an enclosed space and thus the presence of a person in said space;

a proximity detector for detecting the passage of said person through a doorway of said space;

an indicator; and a control unit connected to said motion detector, said proximity detector, and said indicator, said control unit being arranged to:

activate said indicator in a first mode when said motion detector detects motion in said space for indicating that said space is occupied by said person;

activate said indicator in a second mode when said motion detector no longer detects motion in said space and said proximity detector detects no one having passed through said doorway for indicating an emergency in said space; and deactivate said indicator when said motion detector detects no motion in said space and said proximity detector detects that said person has passed through said doorway for indicating that said person has left said space.

10. The occupancy status indicator of claim 9, wherein said indicator comprises a computer display.

11. The occupancy status indicator of claim 9, wherein said indicator comprises a computer display, and further including a computer connected to said computer display, said computer including a communication link for connecting to a communications network for sending occupancy status signals to remote locations.

12. An occupancy status indicator, comprising:

a motion detector for detecting motion in an enclosed space and thus the presence of a person in said space;

a proximity detector for detecting the passage of said person through a doorway of said space;

an indicator including a lamp; and a control unit connected to said motion detector, said proximity detector, and said indicator, said control unit being arranged to:

activate said lamp in a first mode when said motion detector detects motion in said space for indicating that said space is occupied by said person;

activate said lamp in a second mode when said motion detector no longer detects motion in said space and said proximity detector detects no one having passed through said doorway for indicating an emergency in said space; and deactivating said lamp when said motion detector no longer detects motion in said space and said proximity detector detects that said person has passed through said doorway for indicating that said person has left said space.

13. An occupancy status indicator, comprising:

a motion detector for detecting motion in an enclosed space and thus the presence of a person in said space;

a proximity detector for detecting the passage of said person through a doorway of said space;

a computer containing control firmware connected to said motion detector and said proximity detector, said computer including a display, said computer being arranged to:

display a signal on said display in a first mode when said motion detector detects motion in said space for indicating that said space is occupied by said person;

display said signal on said display in a second mode when said motion detector no longer detects motion in said space and said proximity detector detects no one having passed through said doorway for indicating an emergency in said space; and deactivate said signal on said display when said motion detector no longer detects motion in said space and said proximity detector detects that said person has passed doorway for indicating that said person has left said space.

14. The occupancy status indicator of claim 13, wherein said computer includes a communication link for being connected to a communications network for sending occupancy status signals to remote locations.

* * * * *